United States Patent [19]

Stoneburner

[11] 3,930,525

[45] Jan. 6, 1976

[54] SOFT NOSE HAMMER AND MANUFACTURE THEREOF

[76] Inventor: Alva E. Stoneburner, 124 Postoak Road, Wichita, Kans. 67206

[22] Filed: Feb. 3, 1975

[21] Appl. No.: 546,807

[52] U.S. Cl. ..... 145/36

[51] Int. Cl.[2] ..... B25D 1/00

[58] Field of Search ..... 145/36, 29 R, 29 B

[56] References Cited

UNITED STATES PATENTS 1,095,866 5/1914 Horat ..... 145/36 UX

FOREIGN PATENTS OR APPLICATIONS 1,098,742 10/1955 France ..... 145/36

OTHER PUBLICATIONS

*American Machinist*, "Safe Soft Metal Hammer," W. D. Creider, p. 634, Oct. 16, 1930.

*Primary Examiner*—Al Lawrence Smith
*Assistant Examiner*—J. T. Zatarga
*Attorney, Agent, or Firm*—Robert E. Briedenthal

[57] ABSTRACT

A soft head hammer made by splaying or radially spreading an end of a length of water pipe previously given a plurality of diametrically opposed endwise cuts, and thereafter molding the head of the hammer constituted of a relatively soft and lower melting point material about and into such end of the pipe so as to intimately interlock therewith to oppose separation from the pipe which constitutes the handle.

7 Claims, 9 Drawing Figures

FIG. 1
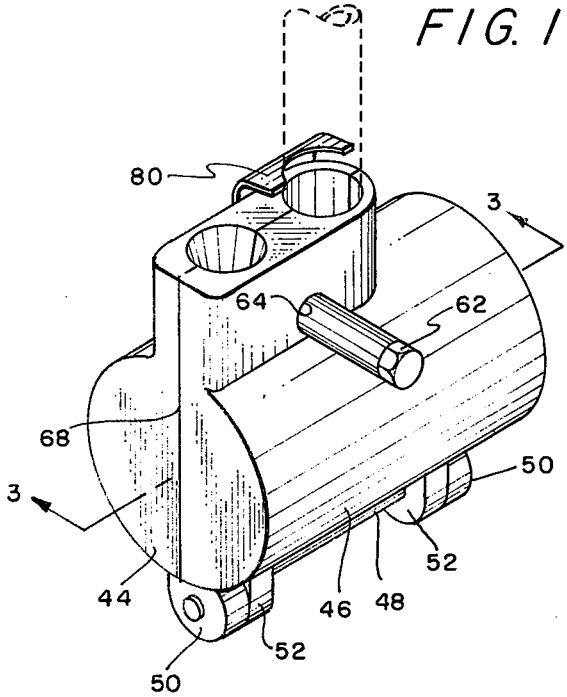
FIG. 2
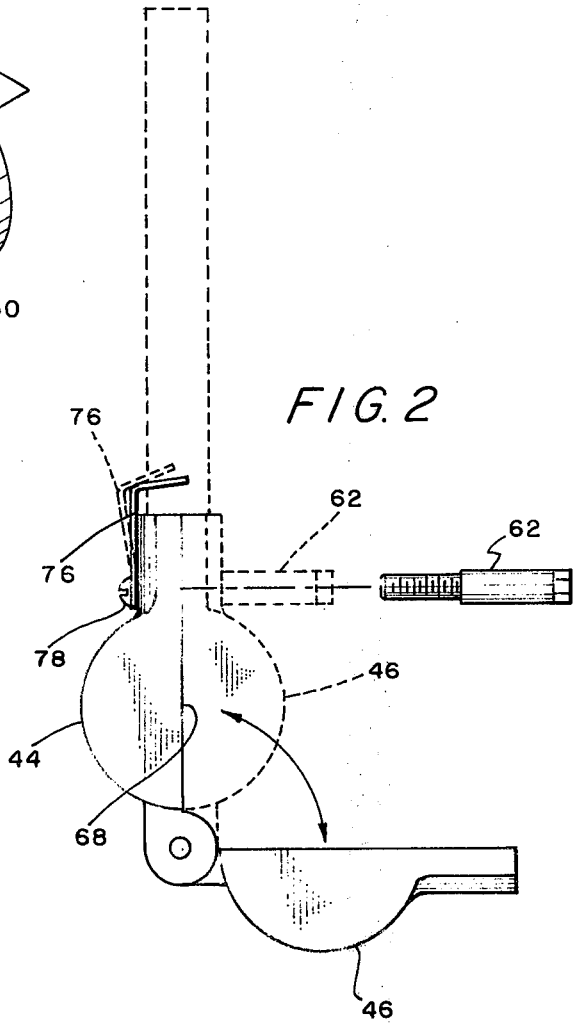
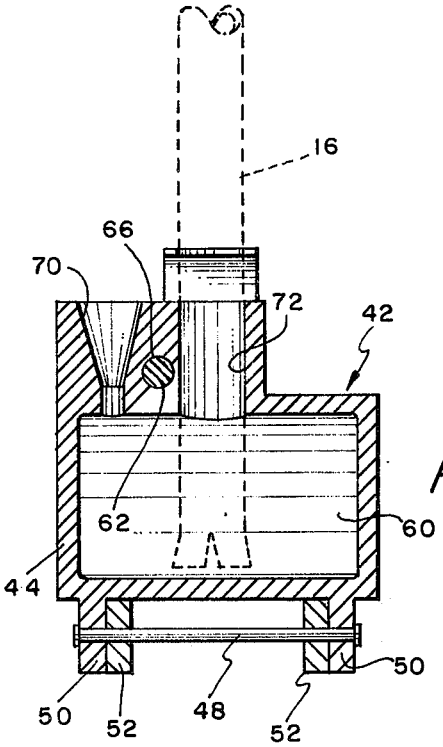
FIG. 3
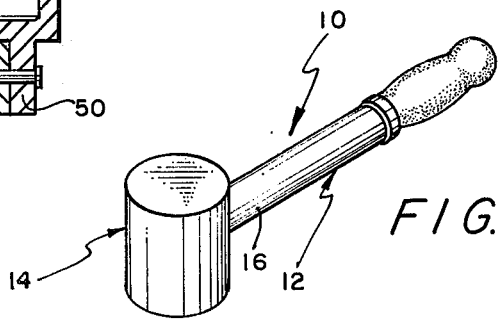
FIG. 4

SOFT NOSE HAMMER AND MANUFACTURE THEREOF

The present invention relates to new and useful improvements in soft head hammers and in the methods and apparatus for making the same. More specifically, the invention has to do with a hammer of the type wherein the handle of the hammer has molded thereon a relatively soft material and having a relatively lower melting point, with the molded material being interlocked with the handle in a manner to optimize both the area of contact therebetween and the resistance afforded separation during use of the hammer.

The need for and the advantages of soft head hammers have long been known and the following U.S. Pats. will serve to inform the uninitiated of some of the prior art proposals:

| | | |
|---|---|---|
| 2,692,626 | Martin | Oct. 26, 1954 |
| 1,707,534 | Nightingale | Apr. 2, 1929 |
| 156,014 | Coburn | Oct. 20, 1874 |
| 3,386,334 | Clay | May 28, 1968 |
| 1,298,382 | Packer | Mar. 25, 1919 |
| 1,029,739 | Bausmith | June 18, 1912 |

Unfortunately, soft head hammers normally have a relatively short useful life as a consequence of their very nature in that their impact surfaces become excessively marred, or the bodies thereof suffer having portions cut or broken away, or become so grossly deformed as to be of no further use. The relatively short life of such type hammers makes it especially important that the cost be held to a minimum, which brings up another unfortunate fact, namely, low cost hammers of this type are often subject to another type of failure by way of the hammer head becoming loose on or separating entirely from the handle. The result is that by and large the user has the choice of purchasing an expensive hammer or an initially low cost hammer that will prove to be not only potentially dangerous in use but also expensive by reason of accelerated deterioration.

A broad aspect of the invention involves the method of making a hammer comprising the steps of providing a plurality of lengthwise slits in one end of a tubular member, splaying the slitted end of the tubular member by forcing a tapered tool into said slitted end of the member, removing the tool, providing a mold establishing the boundaries of a hammer head configuration, pouring a molten hammer head material into the mold while holding the tubular member with the splayed end lowermost and within the mold in spaced relation to the boundaries of the latter in an arrangement such that the poured material surrounds the splayed end of the tubular member and rises within the latter above the slits therein, said material having a lower melting point than that of the tubular member, and removing the mold from the tubular member and the hammer head material after the latter has cooled sufficiently to harden.

Another broad aspect of the invention has to do with a hammer of the type including a metallic handle having a head mounted on one end portion thereof that is of a relatively soft and deformable material, an improved means for securing the head to the handle comprising the handle being tubular in addition to being slitted lengthwise and splayed at said one end portion thereof, said one end portion of the handle being embedded entirely within and spaced from the external surface of the hammer head, said material of the hammer head extending as a continuous mass about said one end portion of the tubular member in uninterrupted contact with all surfaces of said one end portion of the tubular member, whereby head material within and without coacts to interlock with the configuration of said one end of the tubular member to oppose any relative movement of the hammer head on the handle.

Yet another broad aspect of the invention involves in a mold for molding lead about the splayed end of a tubular steel handle to form a hammer head within the hollow of the mold, the improvement comprising the mold having an opening therein that is adapted to receive the handle therethrough, said mold being comprised of two hingedly connected sections that jointly define said opening when the mold is closed, and resilient means mounted on the exterior of one of the sections adapted to engage the handle to oppose endwise movement of the latter when the mold is closed, whereby the handle can be held so that the splayed end thereof is spaced within the hollow of the mold and so that molten lead can enter the interior of the splayed end of the handle.

Numerous other aspects of, features of and objectives of the invention will become manifest upon consideration of the following description of preferred embodiments of the various aspects of the same, such description being presented in conjunction with the accompanying drawings illustrative thereof, wherein:

FIG. 1 is an isometric view of the mold used in molding the hammer head on the handle, such mold being shown in closed position with the handle being partially shown in dashed outline;

FIG. 2 shows and end elevation of the mold of FIG. 1 in opened position with fastening means removed, the mold being shown in closed position in dashed outline in association with the handle also shown in dashed outline;

FIG. 3 is a vertical sectional view of the mold taken upon the plane of the section line 1—1 of FIG. 1;

FIG. 4 is an isometric view of the hammer taken upon a reduced scale;

Figure 5:
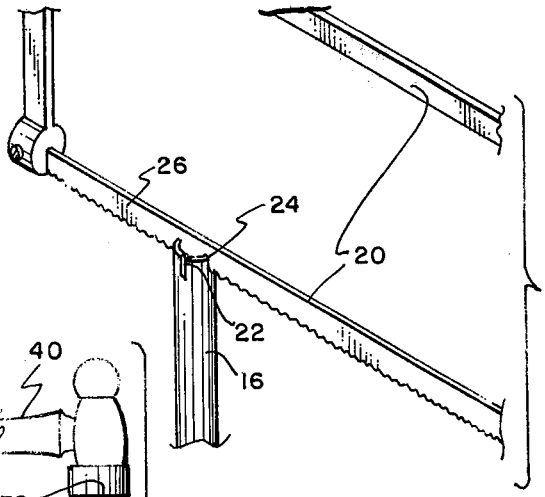
FIG. 5 is a broken view of the step of slitting one end of the pipe by use of a hacksaw preparatory to the splaying of such pipe end.

Referring now to the drawings, wherein like numerals designate like parts throughout the various views, the numeral 10 designates the improved hammer generally; 12 the handle and 14 the head thereof respectively.

Details of the structure of the hammer 10 will be best understood in the light of a description of the tools used and the method of making or manufacturing the same.

In the preferred practice of the invention, the handle 10 is primarily made of common one-half inch steel water pipe 16, which is an inexpensive and readily available material. Indeed, the pipe 16 need not be new and can be such as recovered from houses being torn down or from projects wherein steel water pipe is being replaced by copper or plastic pipe. Significant quantities of useful handle material can be cut from lengths of water pipe that is of no further use for its initial purpose by reason of corrosion, etc.

The head 14 is made of lead which does not need to be of high purity and indeed the material for the hammer head can be conveniently obtained economically as scrap lead and various alloys or mixtures thereof. As a matter of fact, it has been found preferable that the lead not be pure or excessively malleable as such purity shortens the life of the head 14 by deformation and can contribute to separation of the head 14 from the handle 12. Accordingly, alloys of lead of considerably greater hardness than pure lead are deemed preferable. Excellent results have been obtained on using scrap lead and scrap babbitt bearing metal such as may be obtained from non-ferrous scrap metal dealers and the like, such metals being mixed in the ratio of about four pounds of the former to one pound of the latter. Another desirable mixture is obtained on mixing one-half ounce of arsenic of lead with 8 pounds of scrap lead, and to this can be added a small quantity of babbitt (say, one-half pound) if desired.

The pipe 16 to constitute the handle 12 can conveniently be about 10 inches in length and is conveniently one-half inch water pipe that is approximately 7/8 inch outside diameter. Initial preparation of the pipe 16 comprises endwise slitting of the same for about 3/8 inch. As shown in FIG. 5 a hacksaw 20 affords a convenient manner of providing two pairs of slits or slots 22 and 24. The blade 26 of the saw is shown in position completing the pair diametrically opposed slots 24, the diametrically opposed slots 22 having been previously cut with the blade 26 having been disposed 90° from the position shown thereof. It is deemed manifest that the slitting step requires only two sawing operations, each of which cuts one of the pairs of diametrically opposed slots.

Figure 6:
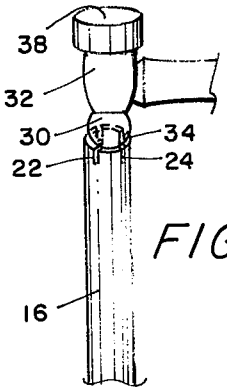
FIG. 6 shows the positioning of the ball end of a ball peen hammer at the slitted end of the pipe preparatory to splaying of such pipe end.

After the end of the pipe 16 has been slitted, the ball-like end 30 of a ball peen hammer 32 (a one to one-and-one-half pound hammer having been found well sized for use with one-half inch water pipe) is positioned as shown in FIG. 6 to protrude, as a tapered tool, partially into the slitted end 34 of the pipe 16.

Figure 7:
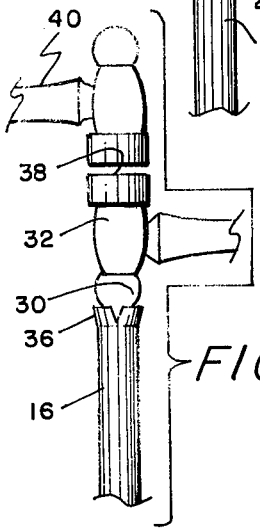
FIG. 7 illustrates the striking of the ball peen hammer positioned as in FIG. 6 with another ball peen hammer to force the ball of the positioned hammer into the pipe end to splay the latter.
Figure 8:
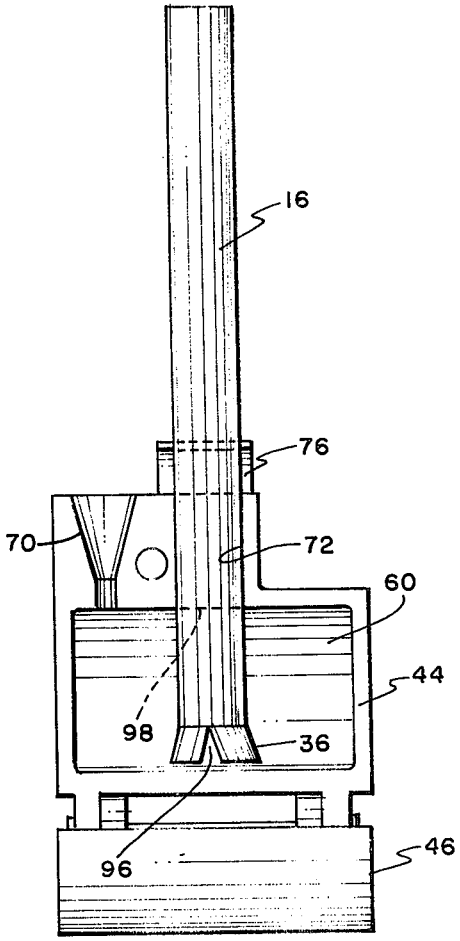
FIG. 8 shows the pipe positioned in the mold preparatory to closing the latter to secure the splayed end of the pipe within and above the bottom of the hollow of the mold; and, FIG. 9 shows the step of pouring the molten hammer head material into the mold, a portion of the latter being broken away to illustrate a part of the interior thereof.
Figure 9:
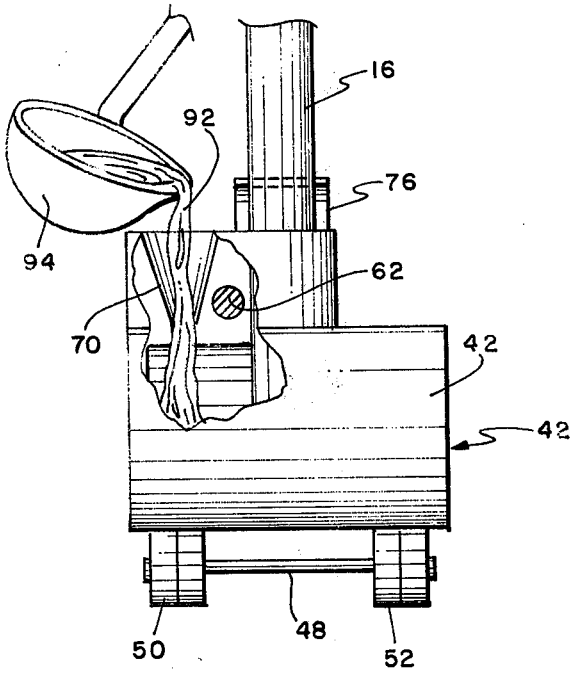

The tapered tool constituted of the hammer is then forced further into the slitted end 34 of the pipe 16 to splay, spread or radially flare out such end of the pipe 16 to arrive at the splayed configuration shown best at 36 in FIG. 8. The forcing of the tapered tool is conveniently effected by striking the flat end 38 of the hammer 32 with another hammer 40 as shown in FIG. 7. Though shown about the same size as the hammer 32, the hammer 40 can be much larger as will be appreciated.

After the pipe 16 has been slitted and splayed as described above, the pipe is ready for the molding of the head 14 thereabout.

The molding operation is performed through the use of a metallic mold 42 comprised of a pair of sections 44 and 46 hinged together by a hinge pin 48 extending through pairs of ears 50 and 52 respectively integral with the sections 44 and 46. The sections 44 and 46 are provided with cavities such that when the sections 44 and 46 are swung into closed position shown thereof in FIG. 1, such cavities define a hollow 60 that is generally cylindrical and complementary to the shape of the head 14.

The sections 44 and 46 are releasably retained in closed position by a threaded bolt 62 that freely extends through an opening 64 in the section 46 and is threaded into an opening 66 in the section 44.

The sections 44 and 46 jointly define at their parting plane or juncture 68 when closed a pair of openings 70 and 72 disposed on opposite sides of the threaded fastener 62, the opening 70 being tapered or funnel-like to facilitate the pouring of molten material into the hollow 60 of the mold 42. The opening 72 is cylindrical and has a diameter slightly larger than the diameter of the pipe 16.

After the pipe 16 has been prepared as previously described, the same is positioned relative to the mold 42 as shown in FIG. 3 with the splayed end 36 of the pipe 16 disposed within and spaced from the confines of the hollow 60. The splayed end 36 of the pipe is positioned as shown prior to closure of the mold 42 for the obvious reason that the dimensions of the opening 72 would not permit insertion after the mold 42 is closed.

While the dimensions of the opening 72 approximate the diameter of the pipe 16, the mold 42 includes means for preventing inadvertent dislodgment of the pipe 16 from the position thereof described above, such means being especially desired as the mold 42 is disposed during the pouring operation with the axes of the openings 70 and 72 vertical and with the pipe 16 extending vertically above the mold 42.

The means for retaining the pipe 16 in its desired position in the mold 42 when the latter is closed is comprised of an L-shaped steel leaf spring 76 having the free end of one leg thereof fastened at 78 to the exterior of the mold section 44 so that the free end of the other leg 80 projects in repose into the external projection of the opening 72. The free end 82 of the spring leg 80 is concaved to be complementary to the pipe 16 as shown. The arrangement is such that the free end 82 of the spring 76 resiliently bears against the side of the pipe 16 when the mold 42 is closed to prevent endwise movement of the pipe 16.

With the pipe 16 positioned relative to the closed mold 42 as described, the molten material 92 can be poured into the hollow 60 of the mold 42 through the opening 70 from a ladle 94. The material 92 is poured in sufficient quantity to fill entirely the hollow 60 and possibly rise a slight bit in the opening 72. The molten material 92 will during such operation entirely surround and make intimate contact with all (internal and external) exposed surfaces of the pipe 16 that are within the hollow 60. It is to be noted that the molten material will flow into and fill the spaces of the divergent slots 96 in the splayed end of the pipe and as a continuous mass extend about the splayed end 36 of the pipe and extend up into the hollow pipe to about the level indicated at 98.

The mold 42, which can be conveniently made of bronze, can be held in any convenient manner during the pouring operation and the period required for cooling sufficient for solidification of the material 92, such as by partially embedding the mold 42 in a bed of sand (not shown).

After the material 92 has solidified, the mold 42 is opened and the pipe 16 and the solidified material 92 are removed therefrom, the latter now being in the configuration of and constituting the hammer head 14. Of course, any material 92 (not shown) on the hammer head 14 conforming to the opening 70 or any cleavage of the mold at the parting plane 68 can be readily removed in any suitable manner by breaking or cutting off or by filling or grinding off.

Though not a necessary component of the hammer 10, it is preferred that the same be provided with a handgrip 100 in the general nature of grips customarily provided on the handle bars of bicycles, and the like. Preferably, the grip 100 is of the type that is of a conventional self-locking and resilient type that must be driven onto the free end of the pipe 16 that has internal protrusions (not shown) that effectively oppose inadvertent dislodgment. The grip 100 has an external surface that is conformable to the hand of the user and constitutes means greatly lessening any likelihood of the handle 12 slipping from the user's grasp.

The intimate interlocking of the material 92 as a continuous integral body entirely about and within the splayed end 34 of the pipe 16 makes the hammer 10 extraordinarily durable while obviously being very simple and inexpensive to fabricate.

Laboratory tests performed by the Engineering Department of Wichita State University have shown that a hammer 10 made as described above and employing a five pound head withstood a maximum load force of 6,080 pounds applied to pull the head 14 from the pipe 16 (the force being applied in alignment with the pipe 16). A similar hammer of smaller size (three-pound head) sustained a maximum force of 4442 pounds.

The material 92 need not be comprised largely of lead or even metallic for that matter, and indeed thermoplastic synthetic resins such as nylon can be employed with notable success. The pipe 16 need not be of steel and if a lighter hammer or a center of gravity closer to the head is desired, the handle 12 can be made of tubular aluminum stock.

Since further elaboration need not be given for those of even very modest familiarity of the art, attention is now directed to the appended claims.

I claim:

1. The method of making a hammer comprising the steps of providing a plurality of lengthwise slits in one end of a tubular member, splaying the slitted end of the tubular member by forcing a tapered tool into said slitted end of the member, removing the tool, providing a mold establishing the boundaries of a hammer head configuration, pouring a molten hammer head material into the mole while holding the tubular member with the splayed end lowermost and within the mold in spaced relation to the boundaries of the latter in an arrangement such that the poured material surrounds the splayed end of the tubular member and rises within the latter above the slits therein, said material having a lower melting point than that of the tubular member, and removing the mold from the tubular member and the hammer head material after the latter has cooled sufficiently to harden.

2. The method of claim 1, wherein the tool is forced into the slitted end of the tubular member by striking the same with an impact tool.

3. The method of claim 1, wherein the tubular member is steel pipe and wherein said one end is slitted by sawing to produce at least one pair of diametrically opposed slits.

4. The method of claim 3, wherein the hammer head material is comprised of lead.

5. The method of claim 4, wherein the tool is forced into the slitted end of the tubular member by striking the same with an impact tool.

6. In a hammer of the type including a metallic handle having a head mounted on one end portion thereof that is of a relatively soft and deformable material, an improved means for securing the head to the handle comprising the handle being tubular and having one end portion thereof slitted lengthwise and flared outwardly at its extremities, said one end portion of the handle being embedded entirely within and spaced from the external surface of the hammer head, said material of the hammer head extending as a continuous mass about said one end portion of the tubular member in uninterrupted contact with all interior and exterior surfaces of said one end portion of the tubular member, whereby head material within and without coacts to interlock with the configuration of said one end of the tubular member to oppose any relative movement of the hammer head on the handle.

7. The combination of claim 6, wherein the handle is comprised of steel pipe, and wherein the hammer head material comprises lead.

* * * * *